United States Patent [19]

Bevacqua

[11] 4,027,122

[45] May 31, 1977

[54] UNITIZED PUSH/PULL DOUBLE POLE SINGLE THROW SWITCH

[75] Inventor: Louis Albert Bevacqua, Des Plaines, Ill.

[73] Assignee: Motorola, Inc., Schaumburg, Ill.

[22] Filed: Dec. 31, 1974

[21] Appl. No.: 537,728

[52] U.S. Cl. ..... 200/77

[51] Int. Cl.[2] ..... H01H 15/18

[58] Field of Search ..... 200/77, 260, 276; 338/172, 198, 200

[56] References Cited

UNITED STATES PATENTS

| | | | |
|---|---|---|---|
| 985,421 | 2/1911 | Klein | 200/77 |
| 1,327,844 | 1/1920 | Schaefer | 200/282 |
| 2,420,913 | 5/1947 | Schellman | 200/77 |
| 2,958,748 | 11/1960 | Barden et al. | 338/172 |
| 2,969,443 | 1/1961 | Barden etal. | 200/77 |
| 3,053,957 | 9/1962 | Duffield | 200/282 |

FOREIGN PATENTS OR APPLICATIONS

| | | | |
|---|---|---|---|
| 164,185 | 6/1921 | United Kingdom | 200/77 |

*Primary Examiner*—David Smith, Jr.
*Attorney, Agent, or Firm*—James W. Gillman; Donald J. Lisa

[57] ABSTRACT

A switch assembly for providing a push-pull, double pole, switch action has molded cylindrical first and second housing portions having first and second pairs of electrically isolated contact terminals fixedly mounted therein in electrical isolation and extending outwardly from the housing portions which are formed with a central aperture therethrough. A switch operating plunger having a cam located intermediate the ends of the plunger is positioned within the housing, the ends of the plunger extending outwardly through the central aperture of the housing portions. The plunger and cam are mounted for limited axial reciprocating movement within the housing portions between a first and second position. A resilient conductive bridge contactor is positioned within the housing and is movable by the cam on the plunger in a direction opposite the movement of the plunger to complete the electrical connection between the first pair of contacts when the plunger is in one position and to complete the electrical connection between the second pair of contacts when the plunger is in the second position. Means secure the housing portions together to provide a unitary housing. One embodiment of the bridge contactor is particularly adapted for miniaturization of the entire switch assembly. The plunger is rotatable within the housing. One end of the plunger is adapted for coupling to external rotary drive means.

2 Claims, 6 Drawing Figures

FIG. 4
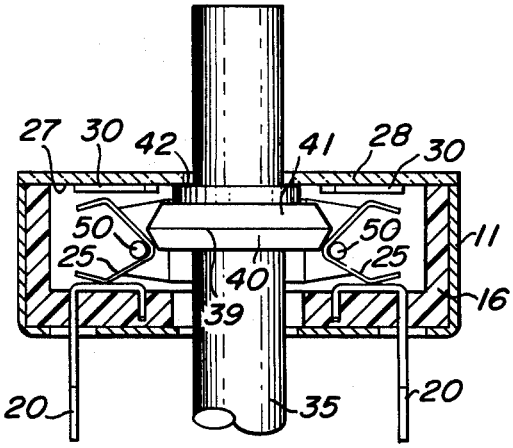
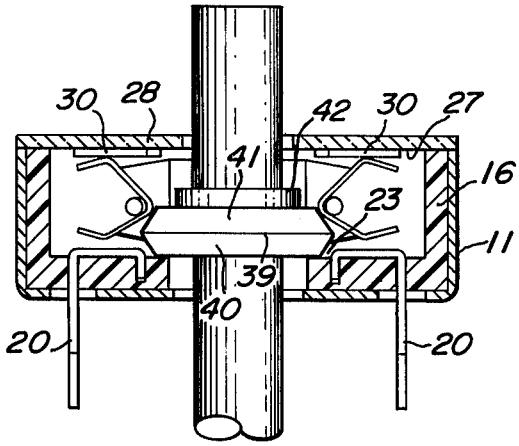
FIG. 3
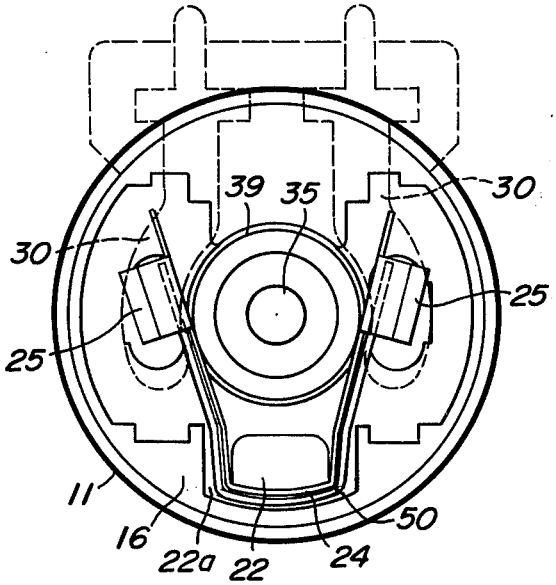
FIG. 2

UNITIZED PUSH/PULL DOUBLE POLE SINGLE THROW SWITCH

BACKGROUND OF THE INVENTION

This invention relates to push-pull switches capable of performing multiple switching operations while being simultaneously adapted for stacking with other electrical controls such as rotary potentiometers.

In the past, single throw momentary switch assemblies have been developed to provide a single switch action while simultaneously having an exposed pinion or plunger shaft for coupling with rotary drive means. Although such switch assemblies are of simple construction, when it has been desired to utilize such switch assemblies to perform multiple switching functions, such as operating a plurality of electrical components from a single control shaft, the design problems and attendant costs of manufacturing such switches have precluded their use in such applications. For example, there is a need for an inexpensive single shaft control which can switch between AM and FM receiver operation in one actuation mode while tuning the receiver to the proper frequency in another actuation mode. Furthermore, as the marketplace places an ever increasing premium on compactness of electrical components, the need is for such a control which is particularly adapted for miniaturization.

SUMMARY OF THE INVENTION

It is an object of this invention to provide an improved push-pull double pole, single throw switch assembly in the miniature control category.

It is another object of this invention to provide a push-pull double pole switch assembly which can be coupled to other switch assemblies and/or rotary switches or controls to form a composite switch assembly.

It is a further object of this invention to provide an improved push-pull double pole single throw switch assembly having an exposed plunger shaft adapted for coupling to rotary drive means to perform multiple switching functions and to operate a plurality of devices.

It is still another object of this invention to provide an improved switch assembly which permits precise cooperation between the movable switch contactor and the cam surface of the operating plunger.

It is still a further object of this invention to provide a simple means of varying the actuating force, as required, while simultaneously providing a positive detent action.

It is an object of the present invention to provide a snap-action contact for quick make and break to reduce arcing and provide positive contact pressure.

Briefly, the invention in its preferred form utilizes a split plastic housing having identical first and second housing portions, into each portion being fixedly mounted a pair of electrically isolated contact terminals which have their ends extending outwardly from the housing through holes therein. The one pair of contact terminals is insulated from the other pair. The housing portions are formed with a central aperture therethrough. A plunger, having a cam intermediate its ends, is mounted within the housing, the plunger ends extending outwardly of the housing through the central aperture. The plunger and cam are axially reciprocable between first and second positions, means being provided to limit said axial movement. A resilient, conductive contactor mounted within the housing is biased radially inwardly into contact with the cam and is movable by the cam axially with respect to the plunger in a direction opposite to the direction of movement of the plunger into contact with the second pair of contact terminals to complete the electrical connection therebetween when the plunger is in the first position and into contact with the first pair of contact terminals to complete the electrical connection therebetween when the plunger is in the second position.

In another embodiment of this invention, the switch assembly includes a molded, cylindrical housing having a first open end and a second end having openings therein. A first pair of electrically isolated contacts is positioned in the housing to extend outwardly through the openings in the second end. A rotatable switch operating plunger is positioned within the housing. The operating plunger includes a cam surface positioned intermediate the ends thereof, the ends of which extend outside the housing. The operating plunger is manually operable between an outward second position and an inward first position. An insulating end plate having a second pair of electrically isolated contacts on the inside thereof is secured to the open end of the housing to hold the switch assembly in assembled relation. A resilient bridge contactor is positioned in the cylindrical housing to be engaged by the cam surface on the operating plunger. The resilient bridge contactor is operable between a first position wherein the contactor engages the second pair of contacts positioned and held on the insulating end plate and a second position wherein the contactor engages the first pair of contacts mounted in the second end of the cylindrical housing to complete the switch action. The positioning of the cam surface portion of the operating plunger with respect to the contactor within the cylindrical housing enables a precise cooperation between the contactor and the cam surface portion of the plunger to perform the multiple switching functions of the push-pull, double-pole, single-throw switch assembly.

Additionally, one of the ends of the operating plunger may be engageable with a pinion for coupling to a rotary drive device to permit the switch assembly to perform the additional function of controlling rotary drive devices.

DESCRIPTION OF THE DRAWINGS

FIG. 2 is a top plan view of the switch assembly in accordance with the instant invention;

FIG. 3 is a sectional view of the switch assembly of the instant invention illustrating the operating plunger and contactor in the first position;

FIG. 4 is a sectional view of the switch assembly of the instant invention illustrating the operating plunger and contactor in the second position;

DETAILED DESCRIPTION

Figures 1, 5, 6:
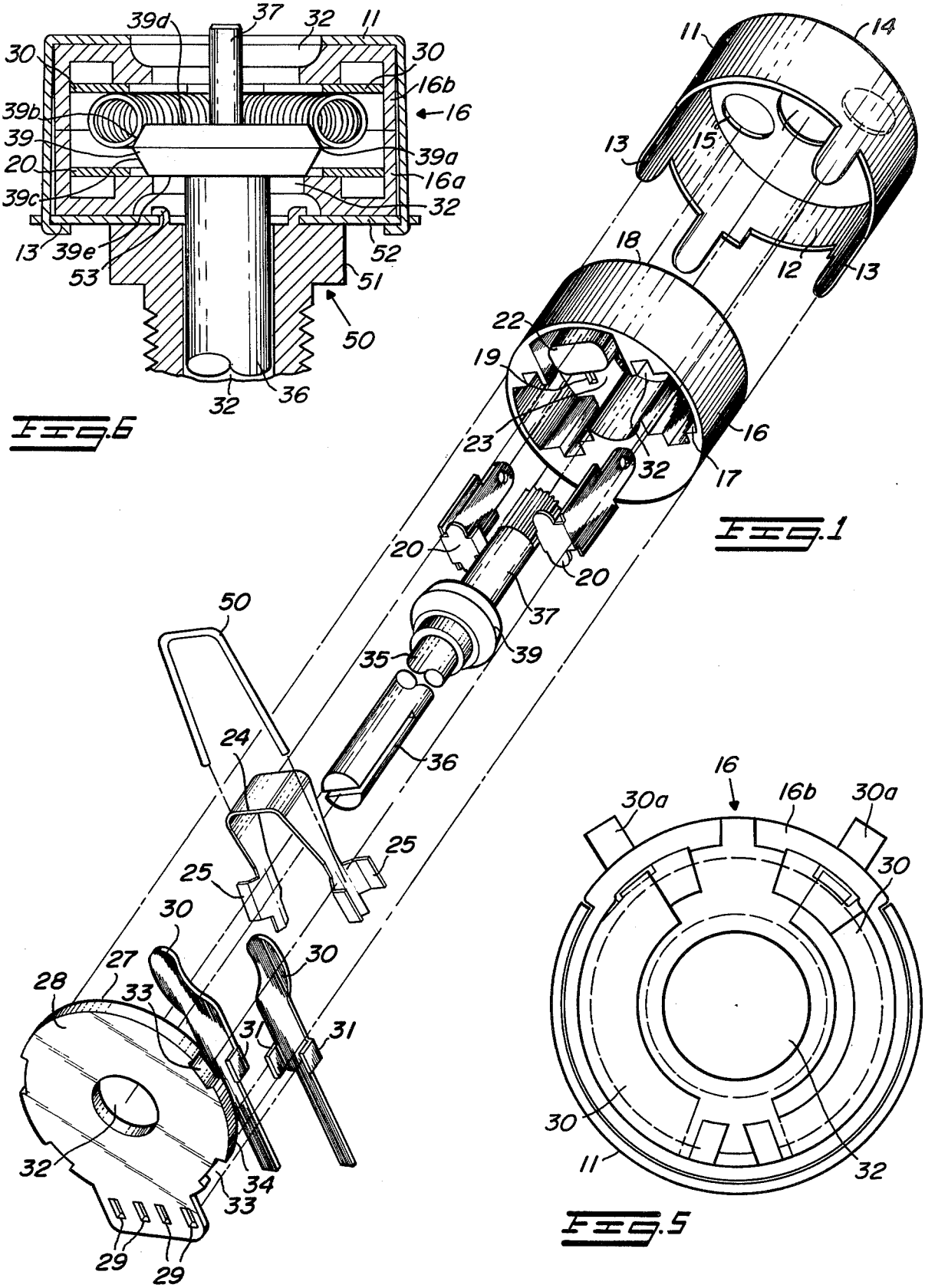
FIG. 1 is an exploded view of the components of the switch assembly in accordance with this invention.
FIG. 5 is a plan view of a second embodiment showing a miniaturized version of the present invention.
FIG. 6 is an elevation view in partial section taken along the line A—A of FIG. 5.

Referring now to the drawings, there is an exploded view in FIG. 1 of the components of the switch assembly which comprises a drawn sheet metal cover 11 having a first open end portion 12 with a plurality of tabs 13 extending outwardly therefrom and a second open end portion 14 having a plurality of openings 15 therein. A cylindrical frame or housing 16 includes a first open end portion 17 and a second end portion 18 having a plurality of openings 19 therein. Preferably, the cylindrical housing 16 is comprised of a molded nylon or other insulative material. A first set or pair of electrically isolated stationary contacts 20 is fixed in the housing 16, which contacts 20 extend outwardly through axially aligned openings 15 and 19 in the end portions of cover 11 and housing 16. The housing 16 includes an integrally molded projection portion 22 therein to which is mounted a resilient bridge contactor 24 such that the movable contactor 24 is held in position within the housing 16. The moveable resilient, conductive contactor 24 is in the form of a U-shaped blade made from a length of metal, and includes V-shaped contactor portions 25 on each end thereof, which contactor portions selectively engage the stationary contacts of the switch assembly, as will hereinafter be described.

A second set or pair of electrically isolated stationary contacts 30 is secured to the inside surface 27 of terminal board or insulating end plate 28 by positioning projections 31 on each of the pair of contacts 30 in the plurality of openings 29 in insulating end plate 28. The end plate 28 includes a plurality of recesses or notches 33 in its peripheral edge 34 thereof, which recesses are adapted to receive the tabs 13 of the cover 11 to hold the switch in assembled relationship, the tabs 13 being bent over the end plate 28 after the switch is assembled. The second open end portion 14 of cover 11, the housing 16 and the insulated end plate 28 each include a central opening 32 therein to accommodate the switch operating plunger 35, as will hereinafter be described.

The rotatable switch operating plunger 35 is axially movable and includes a cam 39 molded integrally thereto intermediate the ends of the plunger 35. End 36 of the plunger 35 extends outwardly through opening 32 in insulating end plate 28 and the other end 37 extends outwardly through opening 32 in housing 16 and in cover 11. The cam 39 and shoulder portion 42 (FIG. 4) restrict the axial movement outwardly of the switch operating plunger 35 in the switch assembly, as will hereinafter be described.

The switch of the instant invention is assembled by positioning the pair of contacts 20 into openings 19 of the second end portion 18 of housing 16 and also through the openings 15 in the end portion 14 of the metal cover 11. The movable contactor 24 is then inserted within housing 16 such that the movable contactor is positioned and held by projection portion 22 such that the U-shaped contactor portions 25 are selectively engageable with stationary contacts 20. The switch operating plunger is positioned within the housing such that end 37 thereof extends through opening 32 in the second end portion 18 of housing 16, and that end 36 extends through opening 32 in end plate 28. The insulating end plate 28 and the stationary pair of contacts 30 thereon are then positioned adjacent housing 16 such that tabs 13 of cover 11 engage the recesses 33 and are bent over end plate 28 to hold the components of the switch in assembled relationship.

In FIG. 4, the operation of the switch assembly of the instant invention is shown when the operating plunger 35 is in the outward position and the shoulder portion 42 of cam portion 39 engages the inward surface 27 of insulating end plate 28. When the plunger 35 is in the outward position, the cam surface 40 of cam portion 39 engages the movable resilient contactor 24 and the resultant camming action holds the V-shaped contactor portions 25 against the pair of contacts 20 positioned in the housing 16 to complete the electrical circuit therethrough. When the movable contactor 24 is held against stationary contacts 20, the contactor portions 25 of the movable contactor are held away from contacting the second pair of stationary contacts 30 thereby preventing any switch action to occur between them.

In FIG. 3, the operation of the switch assembly of the instant invention is shown when the operating plunger is in the inward position and the cam 39 engages the end portion 23 of insulative housing 16 adjacent the end 14 of cover 11. As the plunger 35 is moved inwardly, the resultant camming action between the resilient movable contactor 24 and cam surface 40 of cam portion 39 biases the contactor 24 outwardly until the position is reached that the contactor 24 engages cam surfaces 41 on cam portion 39. The resultant camming between cam surface 41 and contactor 24 biases the contactor portions 25 to engage stationary contacts 30 mounted on the inside surface 27 on insulating end plate 28, thereby completing the electrical circuit therethrough. When the movable contactor 24 is held against stationary contacts 30, the contactor portions 25 are held away from contacting the second pair of stationary contacts 20 thereby preventing any switch action to occur between them.

In FIG. 2, a sectional view of the switch assembly particularly describes the mounting of the movable contactor 24 to the projection portion 22 of housing 16. As shown the U-shaped portion of contactor 24 fits into the channel 22*a* formed between the projection portion 22 and the inside of the housing 16. The positioning of the switch operating plunger 35 and cam 39 thereon with respect to the movable contact 24 is shown to provide the switch action of the instant invention. The expansion of the movable contactor 24 as it passes the high point between cam surfaces 40 and 41 provides a detent switch action and the complementary angles between the cam surface 40 and 41 and the movable contactor 24 coupled with the expansion of the movable U-shaped contactor 24 create a contact bias pressure in the switch assembly to provide a proper feel to the switch.

In a further embodiment of the instant invention, a greater detent or contact pressure may be desired between the cam surfaces 40 and 41 and the movable contactor 24. In such a situation, a U-shaped wire detent spring 50 (FIG. 1) may be adapted to fit in the V portion of the movable contactor 24. The utilization of a detent spring 50 increases the force required to expand the movable contactor when it engages the cam surfaces 40 or 41 of cam 39 on the operating plunger 35. The increased force required to expand the movable contactor 24 which results by the utilization of a wire detent spring 50 increases the contact return force between the movable contactor 24 and the cam 39 and results in a higher bias force in the switch assembly. Thus, by varying the wire diameter of the detent spring 50, the desired contact pressure and bias return force may be obtained.

FIGS. 5 and 6 show another preferred embodiment of the invention in the form of a miniaturized composite switch. For simplicity and clarity, the same reference numbers are used to refer to similar components described in the embodiment of FIGS. 1–4. The housing 16 shown in FIG. 5 is a cylindrical molded insulative split plastic housing formed as two identical cup shaped members 16*a*, 16*b* (FIG. 6) having a central aperture 32 therethrough. Fixedly mounted (by means known in the art, i.e. epoxy, staking or eyelet) on an interior wall portion of housing portion 16*a* is a first pair of electrically isolated crescent shaped terminals 20 with the ends 20*a* (not shown) extending outwardly from the housing portion 16*a* through openings therein. Fixedly mounted in an interior wall portion of the housing portion 16*b* is a second pair of electrically isolated crescent shaped terminals 30 with the ends 30*a* (FIG. 5) extending outwardly from the housing portion 16*b* through openings therein, similarly to the ends 20*a* of the first pair of contact terminals 20. The first and second pairs of contact terminals 20, 30 are also electrically isolated from each other.

Plunger 35, preferably made of metal, is mouted within the housing 16 for axial reciprocation therein between a first and second position. A cam 39, preferably of plastic, is force fitted intermediate the ends 36, 37 of the plunger shaft which extend outwardly from the housing through the central aperture 32. The cam 39 forms an enlarged plunger portion having an outward radial edge 39*a* and a pair of axial end surfaces 39*d*, *e*. The outward edge 39*a* is formed with inclined surface portions 39*b*, *c* of decreasing diameter extending toward each axial end surfaces 39*d*, *e*. Plunger movement is limited by cam axial end surface 39*e* abutting against the interior wall of housing portion 16*a* when the plunger is in the first position (FIG. 6) and by cam axial end surface 39*d* abutting against the interior wall of housing portion 16*b* when the plunger is in the second position (not shown).

A resilient conductive contactor 24 is mounted concentrically about the plunger within the housing 16. The contactor 24 comprises a metal tension coiled spring with its ends connected to form a ring and is of such a diameter relative to the axis of the plunger that it is biased inwardly into contact with the cam 39. The contactor 24 is movable by the cam axially relative to the plunger in a direction opposite to the direction of movement of the plunger such that the contactor is wedged between the inclined cam surface 39*b* and the second pair of contact terminals 30 completing the circuit therebetween when the plunger is in the first position and is wedged between the inclined surface 39*c* and the first pair of contact terminals 20 completing the circuit therebetween when the plunger is in the second position. Thus the tension spring ring 24 is a floating member which is positively moved from one contacting relation with one pair of contacts to the other contacting relation with the other pair of contacts by being cammed and expanded over the maximum diameter portion of the cam and then contracting with a snap action which biases the plunger axially against the interior wall portion of the housing while itself being squeezed into tight electrical contact with the contact terminals mounted at the other end of the housing. The amount of force exerted on the plunger by the spring 24 is a function of the diameter of tension spring ring relative to the axis of the plunger and may also be varied by varying the wire diameter of the contactor 24 thereby providing the desired "feel" to the plunger and the necessary tightness for a good electrical contact. The snap action provides a positive detent feeling when the switch changes state.

Means is provided for securing the two housing portions 16*a*, *b* together to form a unitary housing. This may be done by sonic welding or other known means. Alternatively, a metal cover 11 with a central aperture 32 and suitable openings to accommodate the ends 20*a*, *b*; 30*a*, *b* of the contact terminals may also be provided. Housing 11 is provided with tabs 13 for securing under housing 16*a*. Alternatively a mounting means for mounting to an external support may be provided. The mounting means 50 may comprise an externally threaded bushing 51 having a central aperture 32 therethrough, one end 36 of the plunger extending therethrough, and a flange 52, either integral with the bushing 51 or as a separate washer, being provided for securing to the cover 11 by bending over tabs 13. Bushing 51 may be secured to the washer 52 by turning over ends 53.

As in the embodiment of FIGS. 1–4, the plunger of the miniatured version FIGS. 5–6 is rotatable within the housing 16 and one end of the shaft 36, 37 may be adapted for coupling to a rotary drive means. Rotation of the plunger shaft is possible with or without the spring. Rotation of the spring cleans the contact terminals and prevents the build-up of oxidation, providing improved electrical contact.

The switch assembly of the instant invention can be stacked with other pots and/or switch assemblies as described herein in a manner such that a plurality of switch assemblies and switching functions can be obtained.

The instant invention may have application as a tuning control, a tone control, sensitivity or band switching control or as an on-off control for radios and the like.

The switch assembly of the instant invention provides a push-pull, double-pole, single throw switch which is compact, inexpensive and capable of providing multiple switching and control functions.

I claim:

1. In an electrical switch having first and second housing portions having a common longitudinal axis, first and second pairs of electrically isolated contacts, a resilient contactor means disposed within the housing portions and movable between first and second positions, one pair of the contacts being mounted in each housing portion having one end of each contact terminating exteriorly of the housing portion and the other end of each contact disposed interiorly of the housing portion such that the first and second pairs of contacts are selectively bridged by the resilient contactor means when the latter is in the first or second positions respectively, a cam shaped actuator slidably mounted in the housing portions and movable along the longitudinal axis for moving the resilient contactor between the first and second positions, means for limiting axial movement of the actuator, and means for securing the housing portions together to hold the switch components in assembled form wherein the improvement comprises:

the resilient contactor being formed as a coiled tension spring with its ends joined floating within the housing while being positively moved with a snap-action over the cammed actuator between the first and second positions to bridge one or the other of the pairs of contacts in response to push-pull actuator movements, each housing portion being symmetrical and formed as a cup-shaped insulative member with the open ends facing each other for housing therein the contacts, the resilient contactor and cam-shaped actuator, the actuator being rotatably mounted within the housing portions with the ends of the actuator extending beyond the first and second housing portions respectively, one end being accessible to and rotatable by an operator, the other end configured for coupling said rotational movements whereby the switch is adapted for performing multiple functions, the actuator being movable axially between first and second positions, the cam portion of the actuator being formed with flat face portions at each axial end thereof and the housing portions being formed with interior wall portions, the limiting means including the flat face portions of the actuator respectively abutting the adjacent interior wall portion of the housing portion when the actuator is located in each of the first and second positions.

2. The electrical switch of claim 1, wherein the means for securing the housing portions together comprises a flanged cover member surrounding and conjoining the housing portions by having the flange portions turned over opposite ends of the housing portions.

* * * * *